US006154889A

United States Patent [19]

Moore, III et al.

[11] Patent Number: 6,154,889

[45] Date of Patent: Dec. 5, 2000

[54] PROTECTIVE HELMET

[75] Inventors: Dan T. Moore, III, Cleveland Heights; Charles B. Langston, Cleveland, both of Ohio; Timothy M. Seese, Evanston, Ill.; Paul A. Tamulewicz, Parma, Ohio; Heather B. Moore, Brooklyn, N.Y.; Halley T. Moore, Cleveland Heights, Ohio

[73] Assignee: Team Wendy, LLC, Cleveland, Ohio

[21] Appl. No.: 09/255,448

[22] Filed: Feb. 19, 1999

Related U.S. Application Data

[60] Provisional application No. 60/075,389, Feb. 20, 1998.

[51] Int. Cl.[7] ..... A42B 3/00

[52] U.S. Cl. ..... 2/418; 2/411

[58] Field of Search ..... 2/410, 411, 414, 2/417, 418, 419, 421, 425, 412, 420

[56] References Cited

U.S. PATENT DOCUMENTS

| | | | |
|---|---|---|---|
| 2,991,478 | 7/1961 | Zbikowski | 2/422 |
| 3,105,240 | 10/1963 | Jansson | 2/418 |
| 3,197,784 | 8/1965 | Carlisle | 2/420 |
| 3,315,273 | 4/1967 | Bullard . | |
| 4,307,471 | 12/1981 | Lovell . | |
| 4,477,929 | 10/1984 | Mattsson . | |
| 4,665,567 | 5/1987 | Dilger . | |
| 4,843,642 | 7/1989 | Brower . | |
| 4,856,119 | 8/1989 | Haberle . | |
| 4,864,662 | 9/1989 | Frank . | |
| 5,012,533 | 5/1991 | Raffler . | |
| 5,042,093 | 8/1991 | Legendre . | |
| 5,094,229 | 3/1992 | Pomatto et al. . | |
| 5,269,026 | 12/1993 | McManus . | |
| 5,271,103 | 12/1993 | Darnell . | |
| 5,493,734 | 2/1996 | Nieves-Rivera . | |
| 5,511,250 | 4/1996 | Field et al. . | |
| 5,515,546 | 5/1996 | Shifrin . | |
| 5,544,367 | 8/1996 | March, II . | |
| 5,815,847 | 10/1998 | Holden, Jr. . | |
| 5,862,528 | 1/1999 | Saijo et al. | 2/411 |

*Primary Examiner*—Michael A. Neas
*Attorney, Agent, or Firm*—Pearne & Gordon LLP

[57] ABSTRACT

A protective helmet made from a resilient shell. The shell has a plurality of slits. Each slit has a first end located at a lower edge of the shell and has an adjustable width effective for adjusting the size of the shell. The helmet also has an energy absorbing liner disposed inside the shell. The shell is very stiff to effectively distribute an impact force.

33 Claims, 4 Drawing Sheets

FIG. 7
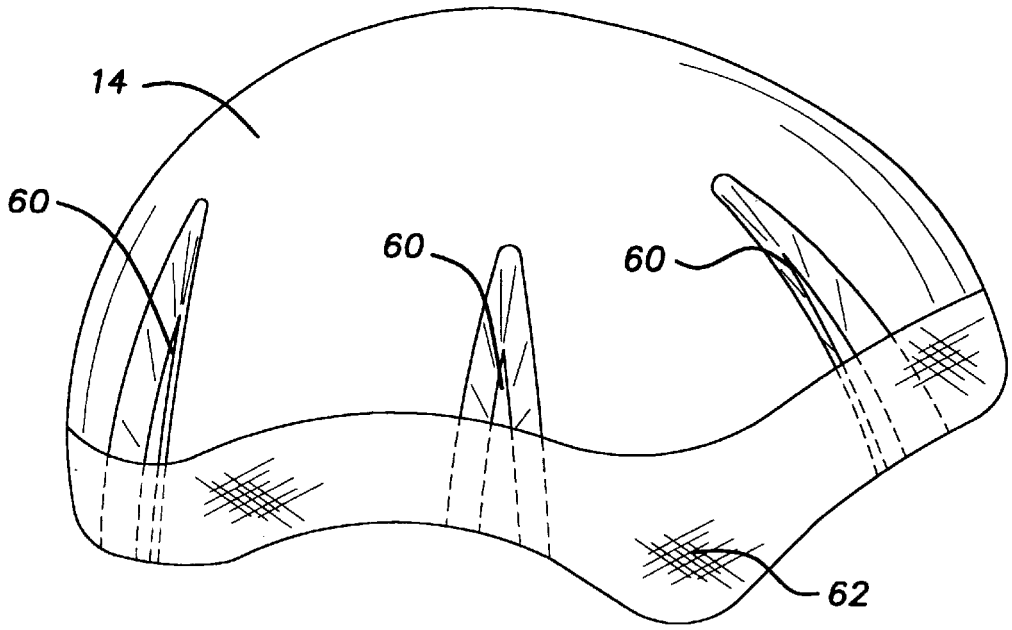
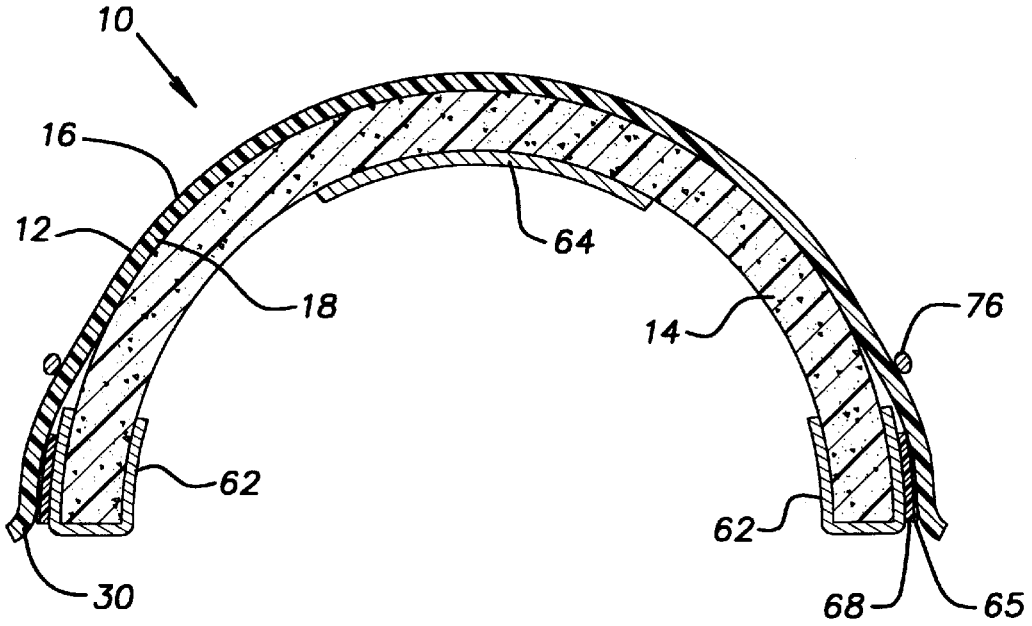
FIG. 8

PROTECTIVE HELMET

This application claims the benefit of U.S. Provisional Patent Application Serial No. 60/075,389 filed Feb. 20, 1998.

BACKGROUND OF THE INVENTION

The present invention generally relates to headgear and, more specifically, to a protective helmet for recreational activities such as skiing, snowboarding, bicycling, rollerblading, skateboarding, horseback riding, rock climbing, spelunking and the like.

Protective helmets for recreational activities, competitive sports, motor sports and other endeavors where a chance of cranial impact is possible are known in the art. Although no helmet is capable of preventing accidents and no helmet can completely prevent injury during an accident, the prior art helmets, particularly those designed for recreational sports, have many disadvantages. One common disadvantage is that many helmets block the wearer's hearing and peripheral visual abilities. This detracts from the wearer's ability to avoid accidents and dangerous situations that may have otherwise been seen or heard in time to react.

Another disadvantage is that many helmets provide a shell that is too weak to provide effective protection from a sudden impact. A good helmet protects the head by distributing the energy, or force, of an impact around the shell of the helmet. The shell, in turn, transfers the energy to an energy absorbing liner. The liner is capable of absorbing more energy if the force is distributed over a greater area of the liner. More energy absorbed by the liner means that less energy will be transferred to the wearer's head. To do this, the shell of the helmet needs to be stiff. If the helmet is not stiff enough, the impact will deflect the shell of the helmet in the area of the impact. In that case, the energy will be transferred to the liner in a more localized manner, resulting in a high force per unit of area that is likely to or could cause greater injury than if the force were more distributed.

Most conventional ski and bicycling helmets have a solid shell of a fixed size made from thermoplastic resins, such as polycarbonate, ABS, acrylic or vinyl. These types of shells have a low elastic modulus (i.e., 300,000 psi), a low flexural strength (i.e., 340,000 psi) and a high percentage elongation at break (i.e., 125%). These parameters are not very conducive to protecting a head against impact. Most of these helmets will deflect a greater amount under impact and transfer the energy of the impact through or into the liner material in a smaller area than would happen if the helmet shell was stronger, stiffer, and/or had less elongation. In addition, the mold cycle for these shells is comparatively long (i.e., 1 to 1.5 minutes).

Another disadvantage of many helmets is the adequacy of the helmet's fit to the wearer's head. Most prior art helmets for recreational sports have many sizing disadvantages. The retailers need to stock sometimes 8 or more sizes relating to head circumference measurements between approximately 19.7 inches to 24.4 inches (or 50 cm and 62 cm). Furthermore, even if two people have heads of the same circumference, their heads can easily vary in width by half an inch. The result is that a person with a wide head would have to buy a helmet that is too long and a person with a long head would have to buy a helmet that is too wide. The traditional solution to this problem is to provide many helmet sizes, typically all with the same width to length ratio, and include a kit of add-in, non-energy absorbing foam to consume any extra space. However, this approach provides for a larger helmet shell than is needed. If the helmet receives an oblique impact, the moment on the helmet will be greater than on a smaller helmet, resulting in more torque being transferred to the wearer's neck. In such a situation, the possibility for, and the severity of, neck and spinal injuries increases.

Another approach for achieving a tight fit is to provide a helmet with an elastic textile that compresses tiles of rigid shell pieces that are supported by an energy absorbing foam. This is similar to a skullcap with an elastic compressing device. This type of helmet is not easily adjusted as it is designed to compress itself to the smallest size possible and, therefore, tends to be uncomfortably tight on the wearer. To provide more comfort to the wearer, the foam can be made softer and the outer shell more flexible. However, softer and more flexible materials do not absorb energy well and decrease the performance of the helmet.

Another method to achieve a tight fit is to provide an inflatable air bladder and/or energy absorbing foam pads between the wearer and the inside of the helmet. Air bladder helmets have a tendency to rebound or bounce, meaning they store the energy of an impact and then redeliver the energy in the opposite direction. Consequently, air bladders are sufficient to absorb low speed impacts of approximately 10 miles per hour or less as experience in football, lacrosse and hockey. However, air bladders are not particularly effective at absorbing the energy of a higher speed impact.

SUMMARY OF THE INVENTION

The present invention overcomes these disadvantages by providing a protective helmet made from a resilient shell. The shell has a plurality of slits. Each slit has a first end located at a lower edge of the shell and has an adjustable width effective for adjusting the size of the shell. The helmet also has an energy absorbing liner disposed inside the shell.

BRIEF DESCRIPTION OF THE DRAWINGS

These and further features of the present invention will be apparent with reference to the following description and drawings, wherein:

FIG. 7 is a side view of an energy absorbing liner for use with the helmet.

FIG. 8 is a cross section of the helmet along line 8—8 of FIG. 1.

DETAILED DESCRIPTION OF THE PREFERRED EMBODIMENTS OF THE INVENTION

Figure 1:
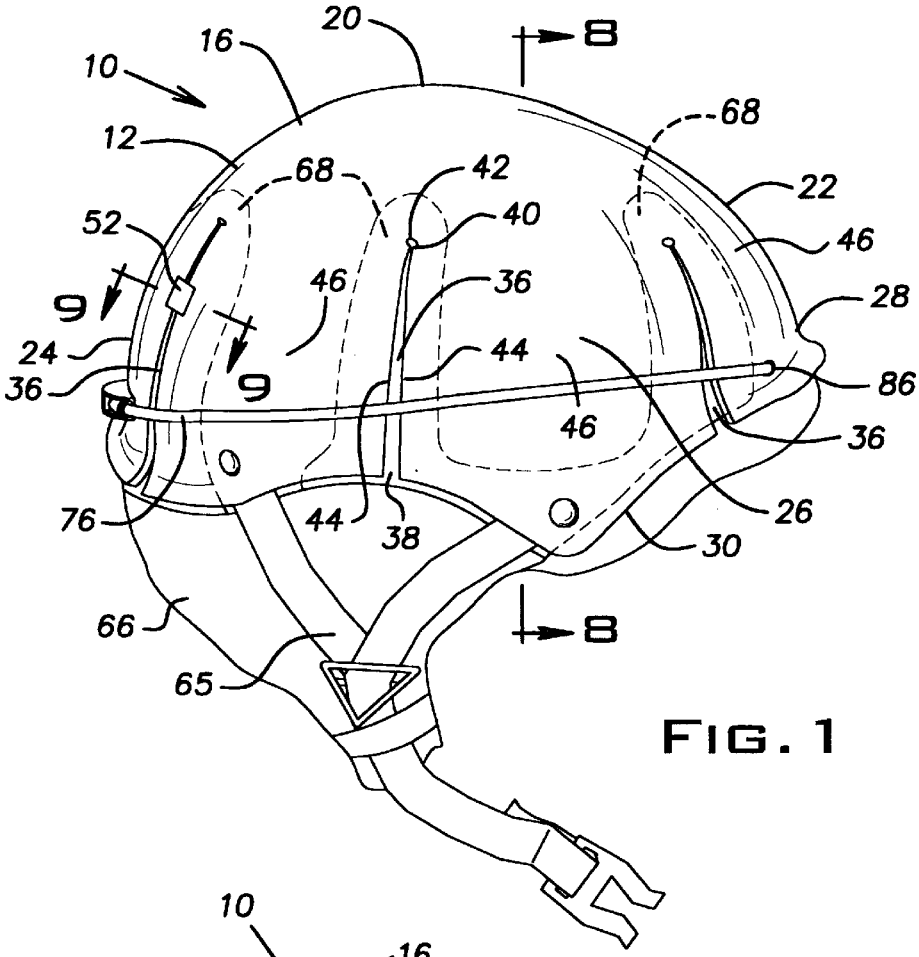
FIG. 1 is a side view of a helmet according to the present invention.

In the detailed description which follows, identical components have been given the same reference numerals, and, in order to clearly and concisely illustrate the present invention, certain features may be shown in somewhat schematic form. When a preferred range, such as 5 to 25, is given, this means preferably at least 5 and preferably not more than 25.

Referring to FIGS. 1, 2, 7 and 8, the present invention provides a helmet 10. The helmet 10 has a shell 12 and an energy absorbing liner 14. The shell 12 is a generally domed shaped unitary or integral piece of resilient material having an exterior surface 16 and an interior surface 18. The shell 12 has a top region 20 (or crown), a front region 22, a rear region 24 and opposite side regions 26. A lower portion of the front region 22 will be referred to as a front brim region 28 of the shell 12. The shell 12 is made to approximate the shape of a human head. Accordingly, the shell 12 is longer in the front to back direction than is wide in the side to side direction. The shell 12 is also provided with a lower edge 30. The lower edge 30 is positioned so that the lower edge 30 in the front brim region 28 of the helmet 10 is located a distance above the bridge of the wearer's nose approximately equal to the width of three of the wearer's fingers. As the lower edge 30 extends around the shell 12 from the front brim region 28 to the side regions 26, the lower edge 30 dips downward so that the shell 12 will at least partially cover the wearer's temples. Approximately in the center of the side regions 26 the lower edge 30 rises to accommodate the wearer's ear and reduce disruption to the wearer's auditory ability. As the lower edge 30 progresses towards the rear region 24, the lower edge 30 again dips downward to allow the shell 12 to provide more coverage over the back of the wearer's skull.

The lower edge 30 of the shell 12 is preferably thicker than the rest of the shell 12 to provide extra stiffness around the lower edge 30 (FIG. 8). In areas other than the lower edge 30, the shell 12 is preferably about 1/16 inches to 1/4 inches thick, more preferably about 1/8 inches thick. Preferably, the lower edge 30 is about 1/16 inches to 5/16 inches thick, more preferably about 1/8 inches to 1/4 inches thick, and even more preferably about 3/16 inches thick.

In addition, the shell 12 preferably flares outward, or away from the wearer, around the lower edge 30 of the shell 12. The flaring is preferably more pronounced in the front brim region 28 and the rear of the shell 12 (FIG. 1). The flare is preferably about 1/8 inches to 3/8 inches from the otherwise domed curvature of the shell 12.

The shell 12 is preferably provided with a series of serrations, or slits 36, spaced around the circumference of the shell 12. Each slit 36 extends from the lower edge 30 of the shell 12 toward the top region 20 of the shell 12. Therefore, each slit is generally vertically oriented. The term vertically oriented is not intended to be limited to being 90° from horizontal, but may include a variety of angular relationships. Preferably, each slit 36 has a first end 38 that is open (i.e., not bridged by any shell 12 material) and located at the lower edge 30 of the shell 12. Each slit 36 has a second end 40 preferably terminated in a stress relief hole 42 near the top region 20 of the shell 12. Measured from the first end 38 to the second end 40, each slit 36 is preferably about 2¼ inches to 4 inches long, more preferably about 2¾ inches to 3½ inches long. The length of the slit 36 will depend on the overall size of shell 12 and how far the lower edge 30 dips in the location of the particular slit 36 being measured. As will be discussed in greater detail below, the slits 36 allow the size of the helmet 10 to be adjusted. Generally, the slits 36 are normally spread apart as a result of the shell's manufacturing process and the shell's composition. The size and circumference of the helmet 10 may be reduced by bringing the edges 44 of the slits 36 closer together. Therefore, another factor in determining the length of each slit 36 is the rigidity of the shell 12. The softer the shell 12, the shorter the slit 36 can be to allow the shell 12 to flex into various sizes. The harder the shell 12, the longer the slit 36 must be to allow the same size adjustment.

At the first end 38, each slit 36 is preferably 1/8 inches to 3/4 inches wide, more preferably about 1/4 inches to 1/2 inches wide. At the second end 40, where the slit 36 joins the stress relief hole 42, the slit 36 is preferably about 1/32 inches to 1/4 inches wide, more preferably about 1/16 inches to 1/8 inches wide. The stress relief hole 42 is preferably about 1/16 inches to 5/16 inches in diameter, more preferably about 1/8 inches to 3/16 inches in diameter.

Preferably, the shell 12 is provided with two to twelve slits 36, more preferably four to eight slits 36, and most preferably six, or at least six, slits 36. The more slits 36 provided in shell 12, the more adjustable and comfortable the helmet 10 will become. However, if there are too many slits 36 the impact performance of the helmet 10 may be decreased, even if the width of each slit 36 is made narrower. Accordingly, there are most preferably about six slits 36 spaced around the helmet 10 with approximately the same amount or distance of shell 12 material disposed between each adjacent pair of slits 36. The shell 12 area disposed between each adjacent pair of slits 36 will be referred to as a flap 46. The broader the flap 46, the greater the ability of the shell 12 to spread the energy of an impact incident on the flap 46 to a larger area of the liner 14. It has been found that by providing a stiff shell 12 and slits 36 for adjusting the helmet's 10 size, the helmet 10 both performs well under impact and can be adjusted to snugly fit the wearer.

In the most preferred embodiment where six slits 36 are provided, the slits 36 are preferably located in the following places on the shell 12 resulting is three general slit 36 locations. First, slits 36 are preferably provided in a transition area between the front region 22 and the side regions 26 such that the first end 38 of the slit 36 is located approximately above the outside corner of the wearer's eyes. Second, slits 36 are preferably provided on the side regions 26 such that the first end 38 of the slit 36 is approximately above the wearer's ears. Third, slits 36 are preferably provided in a transition area between the side regions 26 and the rear region 24 such that the first end 38 of the slit 36 is located above a point approximately half way between the wearer's ears and the center of the back of the wearer's head.

Figure 2:
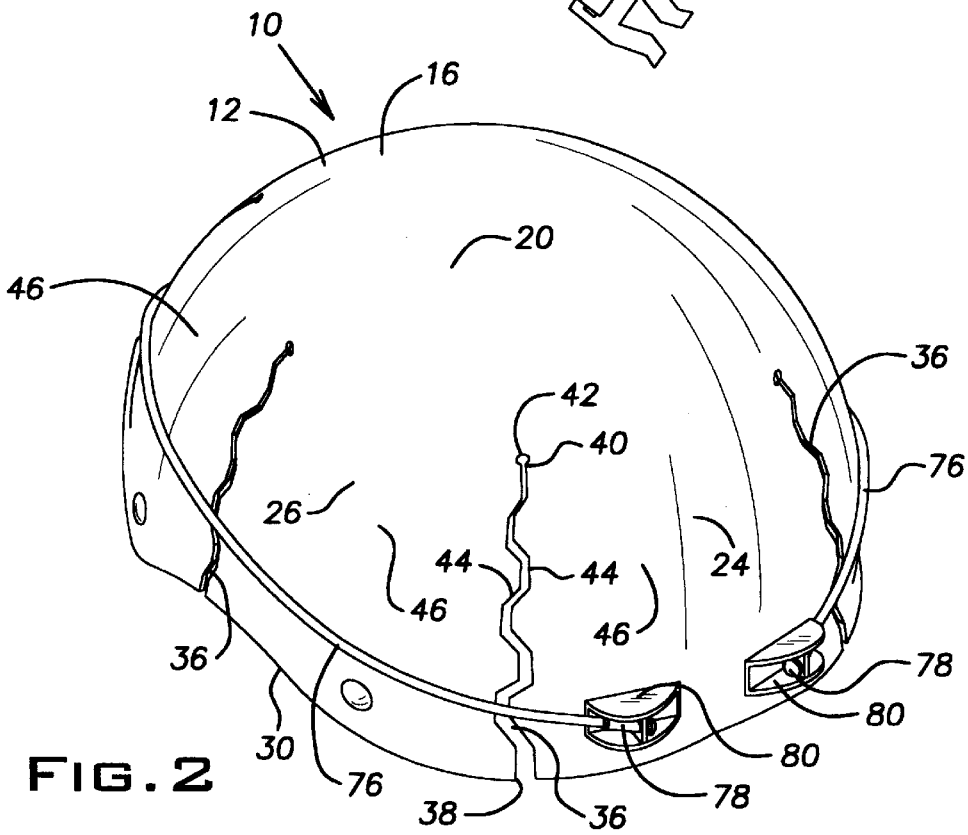
FIG. 2 is a rear perspective view of the helmet having a modified slit arrangement.

In one preferred embodiment, the slits 36 have straight edges 44. This type of slit 36 is most preferably about 1/4 inches wide at the first end 38. In a second preferred embodiment, the slits 36 have edges 44 with a matching non-uniform geometry, such as labyrinth or sawtooth shaped edges 44 as illustrated in FIG. 2. This type of slit 36 is most preferably about 3/8 inches to 1/2 inches inch wide at the first end 38. Although the chance that an object may enter the helmet 10 through the slit 36 is very small, the sawtooth type pattern reduces this possibility by providing a non-uniform, or non-linear, edge 44 that can help block an intruding object. The edges 44 may have other matching geometries, including, for example, a crenelated pattern, a curved radius, a logarithmic arc or a sine wave.

Figure 9:
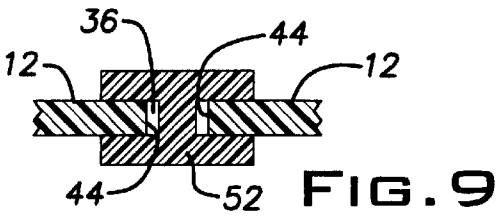
FIG. 9 is a cross section of the helmet along line 9—9 of FIG. 1.
Figure 3:
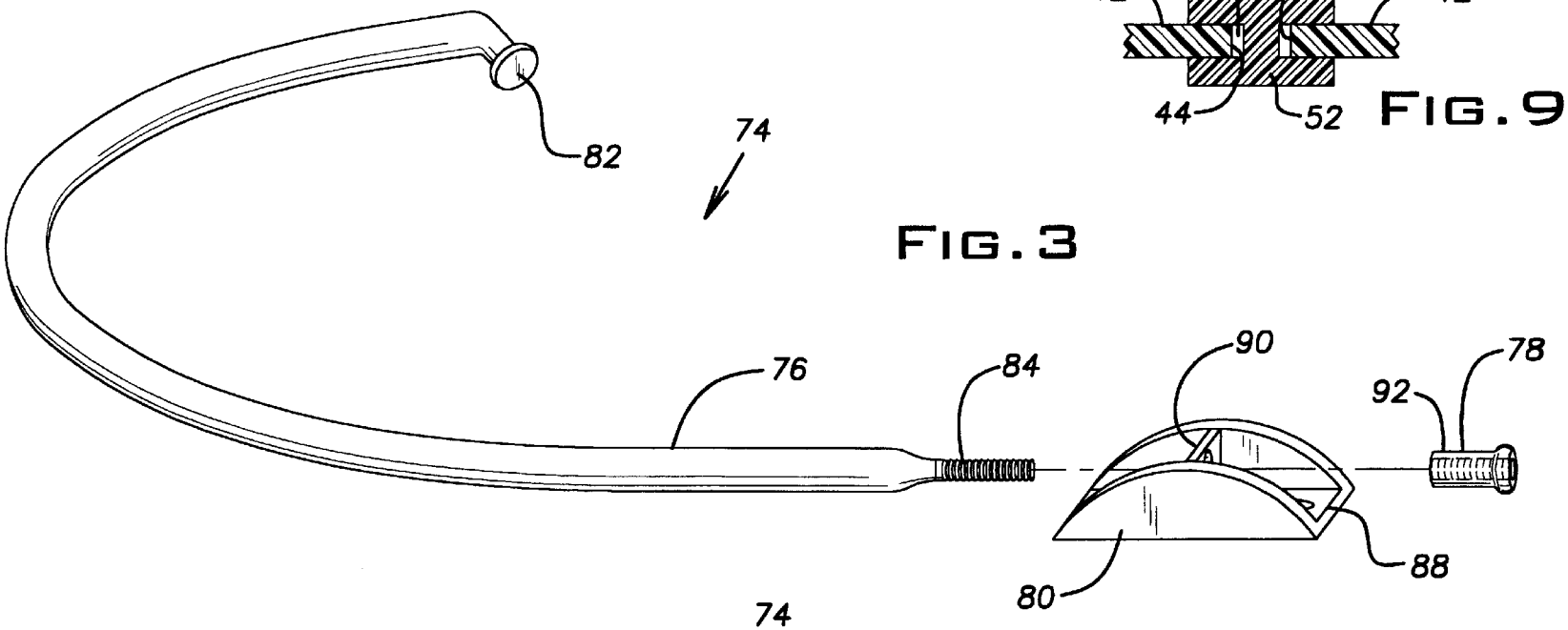
FIG. 3 is a perspective view of a first embodiment of a size adjustment device for use with the helmet.
Figure 4:
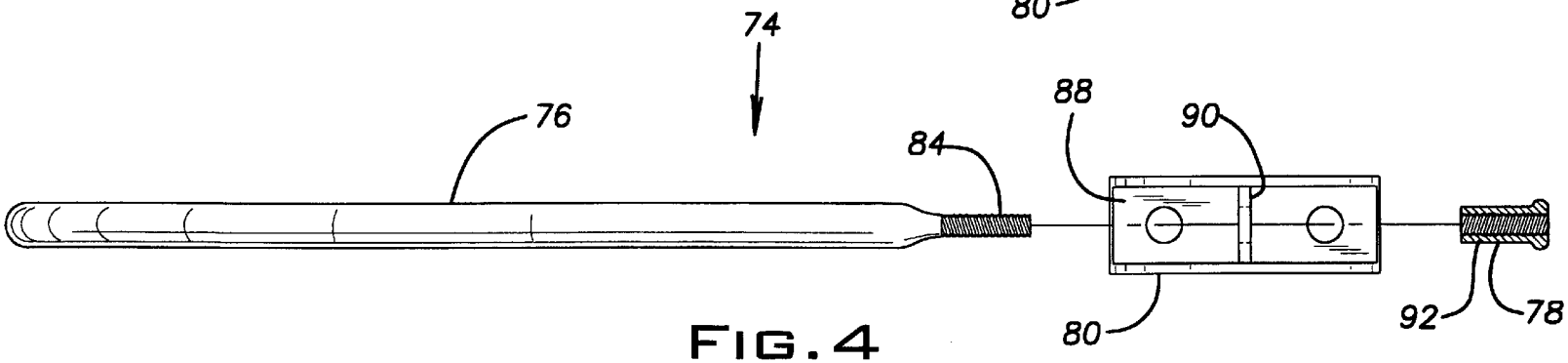
FIG. 4 is a side view of the first embodiment of the size adjustment device.

With additional reference to FIG. 9, an alignment insert 52, preferably made from molded plastic or metal, may be used with any of the preceding slit 36 types to keep the flaps 46 adjacent the slit 36 aligned and to prevent the flaps 46 from overlapping as the edges 44 of the slits 36 are drawn closer together. As shown, the insert 52 preferably has an "H" shaped cross-section to receive the slit edges 44 and hold them in alignment.

A spacer, preferably made from elastomeric material, may also be used with any of the preceding slit 36 types to prevent the slits 36 from becoming narrower than desired. This provides two benefits. First, manufacturing tolerances may allow the slit 36 to become too narrow. Inserting a spacer in a narrow slit 36 will expand the width of the slit 36 and resize the shell 12 appropriately. Second, depending on the shape of a particular wearer's head, it may be advantageous to provide different size slits 36 in different locations of the helmet 10. Since it will be harder to compress a slit 36 having an elastomeric spacer than a slit 36 without a spacer, the spacer changes (i.e., increases) the force required to compress the slit 36 with the spacer. By strategically locating the spacers, the shell 12 size can be properly adjusted. The spacer preferably has an "H" shaped cross-section similar to that of the insert 52. However, the spacer is preferably longer that the insert and occupies nearly the entire length of the slit 36. The spacer can also be tapered to correspond to the shape of the slit 36.

In an alternative, but less preferred, embodiment the shell 12 is provided with slits 36, but the flaps 46 of the shell 12 are wider so that each flap 46 section overlaps each adjacent flap 46. This will still allow size adjustment of the shell 12 and will further prevent an object from entering the helmet 10.

The slits 36 are made either during the molding of the shell 12, after the shell 12 is molded, or partially during the molding and then finished after molding. Preferably, the slits 36 are made while the shell 12 is being molding by shaping the mold to include ridges where the slits 36 are desired to block the shell 12 material from occupying these locations. Alternatively, the slits 36 can be made after a solid shell 12 is molded by cutting the slits 36 out of the shell 12 with a tool, such as a router or a water jet cutter. In another alternative, the slits 36 can be made part way during the molding process by allowing some material to flow into the locations of slits 36. This way, the flaps 46 will be partially connected by a thin layer of shell 12 material when molding of the shell 12 is complete. The thin layer of material may then be removed as described above. However, the removal of the thin layer of material is easier than removing a full layer of material having the same thickness as the rest of the shell 12 since there is less material to remove.

As mentioned above, the helmet 10 is provided with a liner 14. As best illustrated in FIG. 8, the liner 14 is disposed inside the shell. The liner 14 is an energy absorbing device to help cushion the wearer's head against an impact. Accordingly, the liner 14 is made from a material that will crush when subjected to pressure and absorb at least some of the head's acceleration. The liner 14 is preferably made from expanded polystyrene foam with a density of about 4.5 lbs./cu.ft. as is known in the art, less preferably 3.5–6 lbs./cu.ft. The liner 14 is preferably ½ inches to ⅝ inches thick. The liner 14 is preferably secured to the interior surface 18 of the shell 12 with an adhesive, such as glue. Other conventional energy absorbing liners known in the art may also be used.

Referring to FIG. 7, the liner 14 is preferably provided with notches 60 similar to the slits 36 of the shell 12. The notches 60 in the liner 14 allow the liner 14 to adjust in size in the same manner as the slits 36 in the shell 12 allow the shell 12 to be adjusted in size. In this arrangement, the slits 36 and notches 60 cooperate to let the helmet 10 flex and to be adjusted in size. Preferably, the liner 14 has the same number of notches 60 as the shell 12 has slits 36. The notches 60 are preferably aligned with the slits 36. More preferably, the notches 60 are slightly offset from the slits 36 in a rearward direction. If the notches 60 and slits 36 are aligned they also cooperate to allow air to enter and exit the helmet 10 to cool the wearer's head. If the notches 60 are rearwardly offset from the slits 36, air flow will be directed towards the rear of the wearer's head. Inserts or fabric may be optionally provided to allow the wearer to block this venting effect, if desired. Offsetting the notches 60 from the slits 36 will also help prevent objects from entering the helmet 10 and contacting the wearer's head through the slits 36 and underlying notches 60.

Alternatively, the notches 60 are offset from the slits 36 so that the notches 60 are aligned approximately with the center of the flaps 46. As one skilled in the art will appreciate, this arrangement will allow the helmet 10 to be sized, but will result in less venting. In either arrangement, additional vent holes may optionally be provided in the liner 14 and shell 12 at desired locations.

The liner 14 is preferably provided with a cloth-like wrap 62 to make the helmet 10 more comfortable (FIGS. 7 and 8). The wrap 62 is preferably made from a material that will wick moisture away from the wearer. Therefore, the wrap 62 is preferably made from an open cell ester foam, but can also be made from polyester, nylon, cotton, wool or the like with equivalent results. As illustrated, the wrap 62 is preferably annular and has a "U" shaped cross section. The wrap 62 is secured to the liner 14 such that the wrap 62 covers the liner 14 and is located at least between the liner 14 and the wearer's head as if the wrap 62 were a head band worn by the wearer. Additional cloth-like material 64 (FIG. 8) can be placed in the liner 14 to contact the top of the wearer's head. Alternatively, the wrap 62 may cover the whole liner 14. The wrap 62 and any other cloth-like material 64 is preferably secured to the liner 14 with tape and/or adhesive.

Referring to FIGS. 1 and 8, the helmet 10 is preferably attached to the wearer's head by the use of an adjustable harness 65 made from nylon belts and plastic clips, as is well known in the art. The belts are preferably riveted to the shell 12.

Although the helmet 10 provides good heat retaining ability, a warming fleece 66, made from a material such as polyester or wool, may be optionally provided. The fleece 66 hangs from the lower edge 30 of the helmet 10 and is shaped to wrap around the wearer's head to provide coverage over the wearer's ears and neck. The fleece 66 is preferably removably secured to the helmet 10. For this purpose, the fleece 66 is preferably provided with thin plastic tabs 68 stitched to the fleece 66. The tabs 68 are slid between the shell 12 and the liner 14 and held in place by a compression type fit. The tabs 68 are preferably positioned to block air flow through the slits 36, thereby enhancing the helmet's 10 heat retaining ability. Optionally the tabs 68 may be moved or rotated, or the fleece may be rotated slightly around the shell so that one or more tabs 68 are entirely beneath a flap 46 so that air flow is not blocked. The fleece 66 may be removed by pulling the tabs 68 from between the liner 14 and shell 12. Alternative methods of holding the fleece 66 to the helmet 10 are contemplated. They include providing the fleece 66 and helmet 10 with cooperating snaps, hook and loop type fasteners (e.g. VELCRO), zippers, or the like.

Since the exterior surface 16 of the shell 12 comprises the majority of the viewable portions of the helmet 10 while in use, it is preferably given a pleasing appearance. One method of decorating the shell 12 is to paint the shell 12 with a flexible coating system. Painting the shell 12 may require the use of a primer and/or sealer before the paint is applied and a top coat after the paint is applied. The shell 12 can also have color introduced during the molding process by pigmenting the shell 12 material.

Alternatively, an additional layer of colored plastic can be injected on the exterior of the shell 12 while the shell 12 is in the mold. Another technique is to place a fabric, film or nonwoven material against the female side of the mold and mold the shell 12 over the added material. In that case, the material will remain on the outside of the shell 12 after molding is completed. In either of these techniques provision must be made to allow the slits 36 to be formed without leaving a raw or jagged edge to the added material.

Three preferred embodiments of slit adjustment devices for adjusting the size of the helmet 10 will be discussed herein. The size of the helmet 10 is directly proportional to the width of the slits 36. Accordingly, the three preferred embodiments for helmet 10 size adjustment correspond to three devices for adjusting the width of one or more slits 36.

Referring to FIGS. 1 through 4, the first slit adjustment device provides a compression band assembly 74 having a band 76, an adjustable fastener 78 and an anchor 80. The band 76 is preferably made from stainless steel and is shaped like a flattened bicycle spoke, commonly referred to as a blade spoke. A first end of the band 76 is preferably provided with a widened, flattened head 82. A second end of the band 76 is preferably provided with a threaded portion 84 about ¾ inches long. The shell 12 is provided with a hole 86 to allow passage of the band 76 from the interior of the shell 12 to the exterior of the shell 12. The head 82 prevents the band 76 from being pulled through the hole 86. The anchor 80 is made from a material such as cast brass or high density plastic. The anchor 80 is preferably provided with a base 88 which is riveted to the shell 12 on the opposite side of a slit 36 from the hole 86. The anchor 80 is also provided with a fastener retaining flange 90 which retains the fastener 78 and prevents the fastener 78 from moving with respect to the helmet 10, but does allow rotation of the fastener 78. The flange 90 is preferably a piece of anchor material extending perpendicular to the base 88 and defines hole, through which the fastener 78 extends. The fastener 78 is provided with a shaft 92 with an exterior diameter sized to extend through the hole in the flange 90 and a head 92 sized larger than the hole to prevent the head 92 from being pulled through the hole. The shaft 92 of the fastener 78 is internally threaded so as to threadably mate with the threads 84 of the band 76. The shaft 92 is preferably ½ inches to 1½ inches long. The head 92 of the fastener 78 is preferably provided with a tool receiving area, such as a flat blade or Phillips screwdriver receiving recess or a hex head for a nut driver or wrench. When the band 76 is threadably engaged in the fastener 78, the fastener 78 may be rotated with a tool to compress the shell 12 by reducing the width of the slits 36.

As shown, the helmet 10 preferably has two compression band assemblies 74, where the first end of each band 76 extends through holes 86 in the brim region 28 of the shell 12. The anchors 80 are riveted to the rear region 24 of the shell 12 and the bands 76 respectfully circle the left and rights sides of the helmet 10. In this arrangement, each band 76 compresses more than one slit 36 at a time.

As one skilled in the art will appreciate, more band assemblies 74 may be provided until one band assembly 74 is provided for each slit 36. The length of the threaded portion 84 of the band 76 and the shaft 92 will depend on how many slits 36, and the width of those slits 36, that each band 76 crosses and is responsible for compressing. If the band 76 is responsible for compressing one ¼ inches slit 36, the threaded portion 84 and the shaft 92 can be as short as about ¼ inches to ½ inches long.

One skilled in the art will appreciate that the band 76 may be provided with threaded portions 84 at both ends. In this alternative embodiment of the first adjustment device, two anchors 80 and fasteners 78 are provided for each band 76. The band 76 may extend across one or more slits 36. One band 76 may even be used to control the width of all the slits 36 by wrapping the band 76 completely around the shell 12. In that case, holes 86 may be provided in the shell 12 to let the band 76 weave in and out of the shell 12, thereby holding the band 76 in place and preventing the band 76 from slipping up and off the shell 12 as it is shortened.

Figure 5:
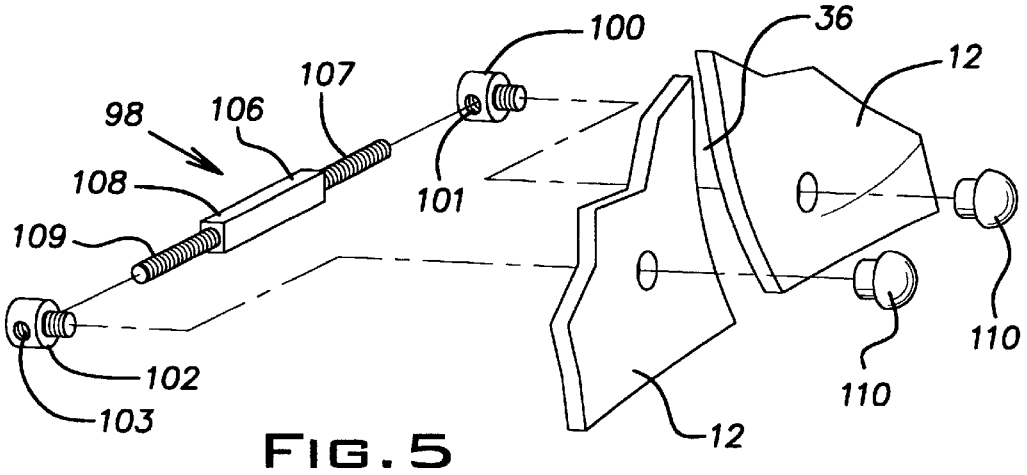
FIG. 5 is an exploded view of a second embodiment of a size adjustment device for use with the helmet.

Referring to FIG. 5, the second slit adjustment device provides a turnbuckle assembly 98. The turnbuckle assembly 98 provides a first stud 100 with a right hand threaded hole 101; a second stud 102 with a left hand threaded hole 102; and a turnbuckle 106 with a first end section 107 having right handed threads, a center body 108, and a second end section 109 having left handed threads. The body 108 is shaped to be engaged and rotated by a tool, such as a small wrench or pair of needle nose pliers. The studs 100, 102 are secured to the shell 12 on opposite sides of the slit 36. The means by which the studs 100, 102 are secured mechanism can be one of any number of common securing means. Most securing means will include inserting the stud 100, 102 through a hole formed in the shell 12. Once inserted through the shell 12, the stud 100, 102 may be fixed in place by a rivet type securement or by threadably engaging with a nut, such as a round head panel nut 110 as illustrated. The turnbuckle 106 is threadably engaged with both studs such that the first end section 107 with the right handed threads engages the first stud 100 with the right handed threaded hole 101 and the second end section 109 with the left handed threads engages the second stud 102 with the left handed threaded hole 103. By turning the center body 108 portion of the turnbuckle 106, the slit 36 can be expanded to the slit's 36 natural, uncompressed limit or compressed to be fully closed. The first and second ends 107, 109 of the turnbuckle 106 are preferably peened so that the turnbuckle 106 cannot be turned out of the studs 100, 102. The turnbuckle 106 is preferably mounted on the interior surface 18 of the shell 12, but may be mounted on the exterior side of the shell 12 with equivalent results. If mounted on the interior surface 18, a very thin wrench may be provided to fit through the slit 36 and turn the turnbuckle 106.

Figure 6B:
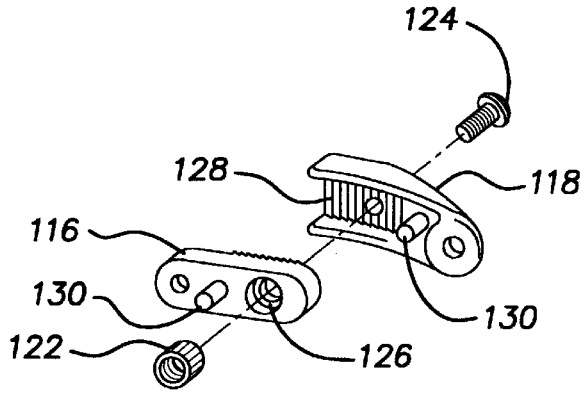
FIG. 6*b* is a rear exploded view of the third embodiment of a size adjustment device.
Figure 6A:
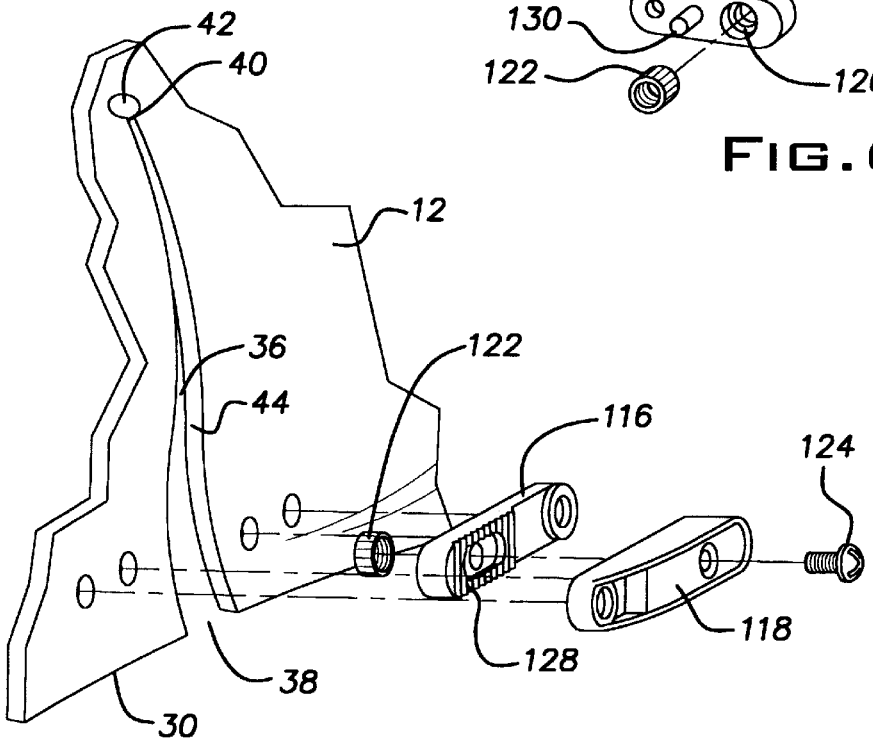
FIG. 6*a* is a front exploded view of a third embodiment of a size adjustment device for use with the helmet.

Referring to FIGS. 6*a* and 6*b*, the third slit adjustment device provides a toothed clip assembly 116. The toothed clip assembly 116 provides an inner clip 118, an outer clip 120, a threaded insert 122 and a screw 124. The clips 118, 120 are preferably made from a molded material, such as nylon. The threaded insert 122 is preferably made from a suitable material such as nylon or metal. The screw 124 is preferably made from metal, more preferably the screw 124 is made from stainless steel. The threaded insert 122 fits in a recess 126 in the back of the inner clip 118 and is used to threadably engage and secure the screw 124, which extends through a hole in both the inner clip 118 and outer clip 120. The exterior surface of the inner clip 118 and the interior surface of the outer clip 120 are each provided with a series of interlocking teeth 128. The teeth 128, when compressed together, prevent the clips 118, 120 from moving with respect to each other. The inner clip 118 is secured to one side of the slit 36 as shown and the outer clip 120 is secured to the opposite side of the slit 36. Preferably, both clips 118, 120 are secured to the shell 12 with flat head rivets, but other securing devices, for example screws and nuts, will work with equivalent results. The size of the shell 12 may be adjusted by forcing the edges 44 of the slits 36 closer together by hand, then tightening the screw 124 such that the teeth 128 of the clips 118, 120 interlock and hold the slit 36 in the desired place. The clips 118, 120 are preferably mounted on the exterior of the shell 12, but may be mounted on the interior surface 18 of the shell 12 with equivalent shell 12 sizing results. Alignment posts 130 are also provided to help mount the clips 118, 120 on the shell 12. However, placing the clips 118, 120 on the interior surface 18 of the shell 12 is less preferred since adjustment of the screw 124 will be difficult due to the presence of the liner 14.

No matter which adjustment device is employed, it is preferred that one adjustment device per slit 36 is used. This way, the width that each slit 36 may be independently adjusted. Therefore, the width of the helmet 10 may be adjusted independent of the length and the length may be adjusted independent of the width. The ability to make these independent adjustments allows the helmet 10 to fit properly on the wearer without the use of filler foam pads. The filler pads do not provide any energy absorbing function. The independent size adjustments also minimize the outside dimensions of the helmet 10 for any particular wearer. This means that if the helmet 10 is impacted, it will have a tendency to twist less than if the helmet 10 were larger. Less twisting reduces the chance and severity of neck and spinal injuries. The independent size adjustments also means that helmet retailers will need to stock less helmet sizes.

As the edges 44 of the slit 36 are brought closer together by the adjustment device, the stress relief hole 42 works as a pivot for the second end 40 of the slit 36 and keeps the shell 12 from splitting.

One skilled in the art will appreciate that even though three specific embodiments of slit 36 adjustment devices are discussed herein, many other mechanical closure devices are suitable for this purpose. For example, the slit adjustment device can provide a sheathed or unsheathed multistranded cable with adjustable fasteners crimped thereto.

Since the size of each person's head varies and since there is usually a dramatic difference between the size of a child's head and an adult head, providing more than one unadjusted helmet 10 size is contemplated. Three sizes are preferably provided, each adjustable from an upper head circumference size to a lower head circumference size by adjusting the width of the slits 36 as described above. The three preferred sizes correspond to three general ranges of head size, as indicated by the following chart.

| General Size | Hat Size | Head Circumference (in inches) |
|---|---|---|
| Child | 6 ¼ to 6 ¾ | 19.8 to 21.3 |
| Adult Small/Medium | 6 ¾ to 7 ¼ | 21.3 to 22.8 |
| Adult Large | 7 ¼ to 7 ¾ | 22.8 to 24.3 |

The shell 12 is preferably made from a stiff material. Conventional helmets are injection molded and are made from an unfilled thermoplastic material, such as polycarbonate, acrylonitrile butadiene styrene (ABS), vinyl or acrylic. These materials and molding technique are generally not capable of making a shell 12 of suitable stiffness. Accordingly, the shell 12 is preferably compression molded from a reinforced material. The material is preferably a thermoplastic, such as polypropylene, polyethylene, or polyethylene terephthalate (PET). Alternatively, the material may be a thermoset resin, such as polyester, vinyl ester or epoxy resin, or other thermoplastic resin. The reinforcement is preferably reinforcing fiber. The reinforcing fiber is preferably glass fiber, including but not limited to chopped glass or random mat (nonwoven strands of continuous fibers). The reinforcing fiber is less preferably Kevlar, carbon fiber or other reinforcing fiber known in the art, such as fabric, fiber matting or cloth. The thermoplastic material is preferably 20% to 80% loaded with reinforcement, more preferably 30% to 65% loaded, most preferably 35% to 45% loaded. The thermoset resin is preferably 20–90%, more preferably 30–80%, more preferably 40–70%, more preferably 50–70%, loaded with reinforcement. Compression molding is preferred to injection molding since the presence of the reinforcement makes injection molding difficult. The materials of the shell 12 tend to have some thermoset properties due to the reinforcement material loading, but is preferably at least twice as stiff as the traditional thermoplastic shells. In addition, the traditional shell materials have a long mold cycle of 1 to 1.5 minutes, whereas the preferred reinforced thermoplastic materials have a mold cycle of about 0.5 minutes. If the material is a thermoset resin, the molding time is about 3 minutes and the shell thickness is thinner, for example at least 10, 20, 30, 40 or 50% thinner, than the glass-filled thermoplastic because the thermoset resin is generally stronger and stiffer.

The following chart compares materials that can be used for the shell 12. The first two, a 62% glass fiber filled vinyl ester compound (sold by QUANTUM COMPOSITES under the designation OC-8800) and 40% glass fiber filled polypropylene (sold by AZDEL under the designation PM10400), provide adequate results for the shell 12. The third, unfilled polycarbonate, represents material used in prior art helmets and is not adequate for the shell 12.

| Characteristic | Test Method | Vinyl Ester Compound | 40% Glass Filled Polypropylene | Unfilled Polycarbonate |
|---|---|---|---|---|
| Percentage Elongation at Break | ASTM D-638 | Negligible | 2.4% | 125% |
| Elastic Modulus (psi) | ASTM D-638 | 3.8 million | 850,000 | 300,000 |
| Flexural Strength (psi) | ASTM D-790 | 3.1 million | 800,000 | 340,000 |
| Glass Content | | 62% | 40% | 0% |

The shell material preferably has an elastic modulus (measured in psi) of greater than 300,000, more preferably greater than 400,000, more preferably greater than 500,000, more preferably greater than 600,000, more preferably greater than 700,000, more preferably greater than 800,000. The shell material preferably has a flexural strength (measured in psi) of greater than 340,000, more preferably greater than 400,000, more preferably greater than 500,000, more preferably greater than 600,000, more preferably greater than 700,000, more preferably greater than 800,000. Optionally, the shell material can have an elastic modulus (psi) and/or flexural strength (psi) of greater than 1 million, 1.5 million, 2 million, 2.5 million or 3 million. The shell material preferably has percentage elongation at break of less than 30%, more preferably less than 20%, more preferably less than 10%, more preferably less than 5%, more preferably less than 3%, more preferably less than 2%, more preferably less than 1%, more preferably less than 0.2%.

Impact tests were conducted on two helmets. The first helmet ("Helmet A") had a shell 12 with slits 36 as described above. The shell 12 was made from ⅛ inches thick polypropylene having a glass content of about 40%. The second helmet ("Helmet B") was a conventional helmet having a traditional shell without slits and made from ⅛ inches thick unfilled polycarbonate. Both helmets had an energy absorbing liner 14 made from ¾ inches expanded polystyrene foam with a density of approximately 4.5 lbs./cu.ft. The shells of both helmets had a specific gravity of about 1.2 and weighed about the same. The tested helmets were placed around an adjustable ball used to simulate a human head. The ball had a maximum diameter of 5½ inches. The ball and some associated bracketry had a weight of 12.6 lbs. The ball was also provided with an accelerometer.

The ball and helmet were dropped from a height of 8.2 feet onto a steel plate rigidly bonded to a concrete floor. A drop from this height allows for an impact velocity of 15.4 miles per hour (mph). Acceleration measurements, at a sampling rate of 25 KHz, of the helmet and ball were recorded beginning at 10 milliseconds before impact and ending at 21 milliseconds after impact. The G force to the simulated head was measured. The test results were as follows. Helmet A: 380 G force to the simulated head. Helmet B: greater than 800 G force to the simulated head. The tests confirmed that the helmet 10 having a stiffer shell made from reinforced polypropylene performed better than the conventional helmet. Even though the reinforced polypropylene shell 12 had slits 36, the helmet 10 having the reinforced polypropylene shell resulted in lower G forces incident on the simulated head.

The helmet 10 with the reinforced polypropylene shell 12 performed better because the shell 12 did not deform as much as the traditional shell upon impact. Less shell deformation provides a larger impact area transferred from the shell 12 to the foam liner 14. The larger impact area crushes the liner 14 over a greater area and increases the amount of energy absorbed by the liner 14. This results in less energy transferred to the wearer's head. It follows that the liner 14 with a stiffer shell absorbs more energy than could be absorbed by a helmet having a shell that deforms more. If the shell deforms too much, as was the case with the shell of the conventional helmet tested, the impact area transferred to the liner 14 will be small and the liner 14 will not absorb as much energy. In other words, the stiffer the shell, the better the helmet can distribute a point load of impact over the shape of the helmet, allowing the energy absorbing liner 14 to absorb more of the energy resulting from the impact. This holds true even with the presence of slits 36.

A helmet having a vinyl ester material shell was not tested in this manner, but it is believed that such a helmet would give improved results due to its greater stiffness. Vinyl ester also has lower elongation properties than the other materials. However, these properties also make the shell hard to adjust using the slit scheme described herein. A greater number of slits 36 and size adjustment devices would be required.

Although particular embodiments of the invention have been described in detail, it is understood that the invention is not limited correspondingly in scope, but includes all changes and modifications coming within the spirit and terms of the claims appended hereto.

What is claimed is:

1. A protective helmet comprising, a resilient shell having an elastic modulus of greater than 400,000 psi and a flexural strength of greater than 400,000 psi, the shell having a plurality of slits, each slit having a first end located at a lower edge of the shell and having an adjustable width effective for adjusting the size of the shell; and an energy absorbing liner disposed inside the shell.

2. The helmet according to claim 1, wherein the shell has an elastic modulus of greater than 700,000 psi and a flexural strength of greater than 700,000 psi.

3. The helmet according to claim 1, wherein the shell has an elastic modulus of greater than 1,000,000 psi and a flexural strength of greater than 1,000,000 psi.

4. The helmet according to claim 1, wherein the shell is made of a thermoset resin and wherein the shell has an elastic modulus of greater than 500,000 psi and a flexural strength of greater than 500,000 psi.

5. The helmet according to claim 1, wherein the shell is made from a reinforced thermoplastic material.

6. The helmet according to claim 5, wherein the reinforced thermoplastic material has a glass content of 30% to 65%.

7. The helmet according to claim 5, wherein the thermoplastic material is reinforced with reinforcing fiber.

8. The helmet according to claim 5, wherein the thermoplastic material is polypropylene.

9. The helmet according to claim 1, wherein each slit is vertically oriented.

10. The helmet according to claim 1, wherein each slit is defined by a pair of edges, the size of the shell being adjustable by bringing the edges of at least one slit closer together.

11. The helmet according to claim 10, wherein each of the edges are generally straight.

12. The helmet according to claim 10, wherein each pair of edges have a matching non-uniform geometry.

13. The helmet according to claim 12, wherein the non-uniform geometry is a sawtooth-type pattern.

14. The helmet according to claim 10, further comprising an alignment insert having a "H" shaped cross section, the insert disposed in one of the slits so that the insert receives the edges of the slit and holds the edges in alignment.

15. The helmet according to claim 10, further comprising a slit adjustment device.

16. The helmet according to claim 15, wherein a separate slit adjustment device is provided for each slit.

17. The helmet according to claim 15, wherein the slit adjustment device is a turnbuckle assembly having a first stud secured to the shell, a second stud secured to the shell, and a turbuckle crossing at least one slit, the turnbuckle having a first end threadably engaged with the first stud and a second end threadably engaged with the second stud.

18. The helmet according to claim 15, wherein the slit adjustment device is a toothed clip assembly having a first clip, the first clip having outwardly projecting teeth and secured to the shell adjacent one of the edges of one of the slits, and a second clip, the second clip having inwardly projecting teeth and secured to the shell adjacent the other of the edges of the slit, the teeth of the first clip and the teeth of the second clip interlocking to prevent the clips from moving with respect to each other when compressed together.

19. The helmet according to claim 1, wherein each slit has a second end terminated with a stress relief hole.

20. The helmet according to claim 1, wherein there are at least four slits.

21. The helmet according to claim 1, wherein there are at least six slits.

22. The helmet according to claim 1, wherein there are six slits.

23. The helmet according to claim 1, wherein each slit has a second end and a width of the first end is greater than a width of the second end.

24. The helmet according to claim 1, wherein the liner is made from expanded polystyrene foam.

25. The helmet according to claim 1, wherein the liner is provided with a plurality of notches, the notches allowing the liner to adjust in size when the size of the shell is adjusted.

26. The helmet according to claim 25, wherein each notch is associated with one of the slits.

27. The helmet according to claim 26, wherein each notch is offset in a rearward direction from each associated slit.

28. The helmet according to claim 1, wherein the liner is attached to an interior surface of the shell.

29. The helmet according to claim 1, further comprising a fleece, the fleece adapted to hang from the lower edge of the shell.

30. The helmet according to claim 29, wherein the fleece has a series of tabs, the tabs being held between the shell and the liner.

31. The helmet according to claim 30, wherein each tab is positioned to cover one of the slits.

32. The helmet according to claim 30, wherein each tab is movable from a first position where the tab is positioned to cover one of the slits to a second position under a flap.

33. A protective helmet comprising, a resilient shell having an elastic modulus of greater than 400,000 psi and a flexural strength of greater than 400,000 psi, the shell having a plurality of slits, each slit having a first end located at a lower edge of the shell and having an adjustable width effective for adjusting the size of the shell, each slit being defined by a pair of edges, the size of the shell being adjustable by bringing the edges of at least one slit closer together by means of a slit adjustment device; said slit adjustment device being a compression band assembly having a band, the band having a first end secured to the shell, the band crossing at least one slit and having a second end threadably secured to a fastener, the fastener being held by an anchor, the anchor being secured to the shell; an energy absorbing liner disposed inside the shell.

* * * * *